US010119342B2

(12) United States Patent
Breaux et al.

(10) Patent No.: US 10,119,342 B2
(45) Date of Patent: Nov. 6, 2018

(54) ROPE SOCKET

(71) Applicant: DOWNHOLE AND DESIGN INTERNATIONAL CORP, Houma, LA (US)

(72) Inventors: Aaron Breaux, Raceland, LA (US); Keith Fry, Watertown, TN (US); Lance Fry, Raceland, LA (US)

( * ) Notice: Subject to any disclaimer, the term of this patent is extended or adjusted under 35 U.S.C. 154(b) by 630 days.

(21) Appl. No.: 14/671,791

(22) Filed: Mar. 27, 2015

(65) Prior Publication Data

US 2016/0281451 A1 Sep. 29, 2016

(51) Int. Cl.

| | |
|---|---|
| ***E21B 31/00*** | (2006.01) |
| ***E21B 23/14*** | (2006.01) |
| ***E21B 17/02*** | (2006.01) |
| ***E21B 23/00*** | (2006.01) |

(52) U.S. Cl.
CPC ..... *E21B 17/023* (2013.01); *E21B 23/00* (2013.01)

(58) Field of Classification Search
CPC ..... E21B 17/023; E21B 33/00; E21B 31/00; E21B 23/00; E21B 43/11852
See application file for complete search history.

(56) References Cited

U.S. PATENT DOCUMENTS

| | | | | |
|---|---|---|---|---|
| 8,807,228 | B2 * | 8/2014 | Martin | E21B 17/1057 166/242.2 |
| 2007/0046051 | A1 * | 3/2007 | Streater, Jr. | E21B 31/18 294/86.27 |
| 2015/0345231 | A1 * | 12/2015 | Thomas | E21B 17/06 166/377 |

* cited by examiner

*Primary Examiner* — Nicole Coy
(74) *Attorney, Agent, or Firm* — AyoubIP; Ahab Ayoub

(57) ABSTRACT

An improved rope socket for downhole operations, capable of separating within the wellbore to permit removal of upper components and attached wireline, while lower components including an uphole-facing fishing neck remain attached to a tool string or fish within the wellbore. Also, an improved drop bar for actuating a release mechanism of the improved rope socket. The improved drop bar includes wheel assemblies having integrated axles to provide a stronger axle capable of offset placement along the circumference of the drop bar.

16 Claims, 4 Drawing Sheets

ROPE SOCKET

FIELD OF THE INVENTION

The invention relates generally to an improved rope socket and related components for use in downhole operations.

BACKGROUND

In a variety of hydrocarbon exploration and production operations, downhole tools are utilized to carry out desired tasks at locations within a wellbore. Different types of downhole tools may be utilized to drill wellbores, deploy tubing and other equipment downhole, perform testing operations, conduct servicing operations, and perform other tasks. When utilizing wireline or other cable connections, a rope socket is often utilized to connect the tool string to the cable.

During these operations, a downhole tool (or tool string) may become stuck in the wellbore or disconnected from its conveyance. The lodged tool may be referred to as a fish, and a fishing operation may be performed in an attempt to retrieve it. In a fishing operation, a fishing tool may be deployed downhole from a surface rig or platform. The fishing tool typically includes a downhole-facing attachment end intended to engage the tool to be retrieved.

SUMMARY

In various embodiments, an improved rope socket and methods for its use are disclosed. Embodiments of the rope socket include an internal separation mechanism which, when actuated, permits separation of select upper components of the rope socket from lower components, which may remain connected to a tool string within a wellbore, while upper components and a connected cable, such as a wireline, may be removed from the wellbore. Upon separation, the lower components provide an upward-facing internal fishing neck operatively connected to a tool string (or fish).

In various embodiments, actuation of the release mechanism of the improved rope socket may occur via an improved drop bar lowered into the wellbore to actuate the mechanism. The improved drop bar may include various wheel assemblies having integrated axles for more securely attaching the wheels and providing for ease of field redress.

DETAILED DESCRIPTION

Figure 1A:
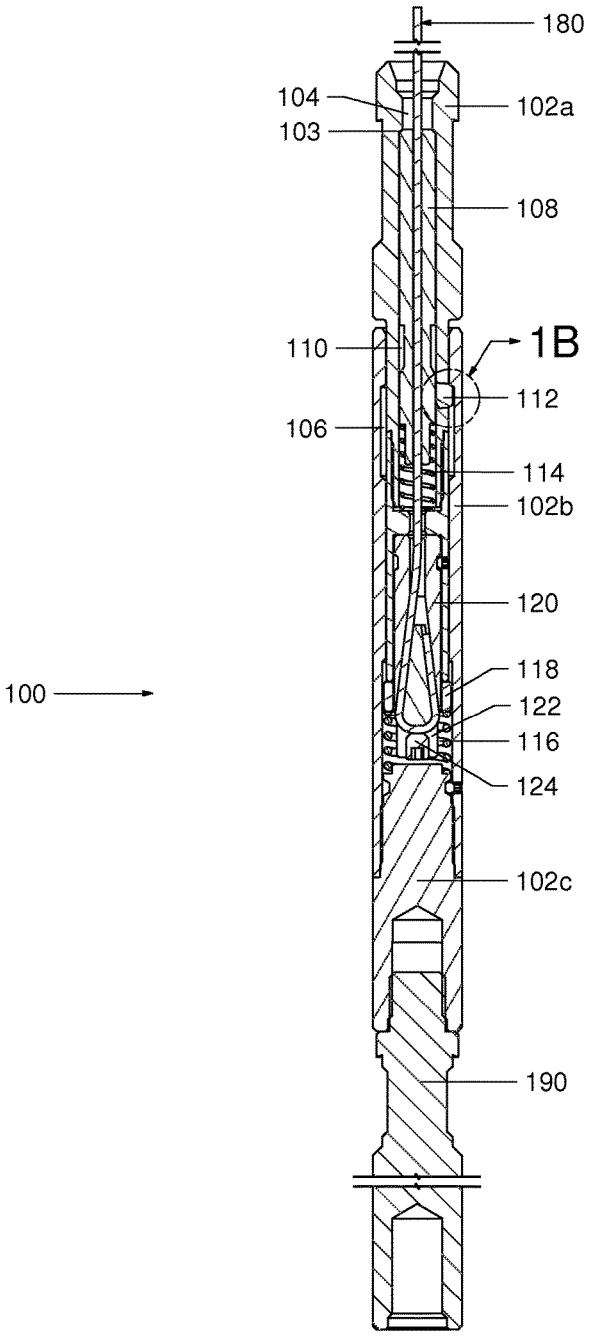
FIGS. 1A-1B show one embodiment of an improved rope socket.

As shown in FIG. 1A, one embodiment of a rope socket 100 is configured to operatively connect a wireline 180 to other components of a tool string 190, typically via a threaded (or some other) connection between the tool string 190 and the rope socket 100.

The rope socket 100 comprises a housing having a number of operatively-connected sub-assemblies ("sub" or "subs"), which in one embodiment include an upper sub 102*a* (possibly having an external fishing neck) operatively connected via a fish neck sub 102*b* (having an internal fishing neck 106), to a lower sub 102*c* configured to operatively connect the tool string 190. The lower end of the lower sub 102*c* may include threading or other connection elements selected to connect to particular configurations of tool string 190 components. In one embodiment, the lower sub 102*c* comprises a crossover sub for adapting to a different configuration of tool string 190 connection. In one embodiment (not shown), a crossover sub connects between the lower sub 102*c* and tool string 190 to operatively connect differing types of connection elements.

As will be shown and described in detail below, once operatively connected to a tool string 190 within the wellbore, if unable to retrieve the tool string 190 by pulling with the rope socket 100, or if separation of the tool string 190 from the wireline 180 is desired, the rope socket 100 is configured to separate, leaving the lower sub 102*c* operatively connected to the tool string (or "fish" if stuck) 190, and the fish neck sub 102*b* connected to the lower sub 102*c*, while the upper sub 102*a* and other components of the rope socket 100 are then retrievable from the wellbore via the wireline 180.

Such a configuration advantageously provides a stronger internal fishing neck 106 connected to the tool string 190, for operatively connecting to various retrieval tools. Another advantage of such a separable configuration is the capability to remove components of the rope socket 100 from the wellbore, along with the entirety of the wireline 180 (instead of risking a breakage and loss of the wireline 180 into the wellbore), while also providing an up-hole facing internal fishing neck 106 connected to the tool string or fish 190, for additional retrieval efforts. Additionally, such a separable configuration is preferable to prior art approaches such as cutting the wireline 180 near the rope socket 100, which typically leaves a piece of the wireline 180 protruding from the top of the rope socket 100, making future connection efforts difficult.

In the embodiment of FIG. 1A, a longitudinal release plunger 108 is disposed substantially within a cavity 104 of the upper sub 102*a*, and moveable within the cavity 104 between a first (or locked) position towards the top of the cavity 104, and a second (or unlocked) lower position within the cavity 104. In the embodiment shown, the release plunger 108 is prevented from exiting the top of the cavity 104 by an internal shoulder 103 of the upper sub 102*a*, although other means known in the art may be utilized to retain the release plunger 108 within the cavity 104.

The release plunger 108 includes an indented section (or indent) 110, in an outer surface thereof. The indent 110 may be disposed along an entire circumference of the release plunger 108, or alternatively, may be disposed in one or more discreet areas of the surface of the release plunger 108, selected to align with one or more lugs 112, as will be shown and described. A release plunger spring 114 may be operatively connected to a lower end of the release plunger 108 to bias the release plunger 108 towards the locked position at the upper end of the cavity 104 and thus advantageously lessen the likelihood of unintended unlocking of the rope socket 100.

Figure 3:
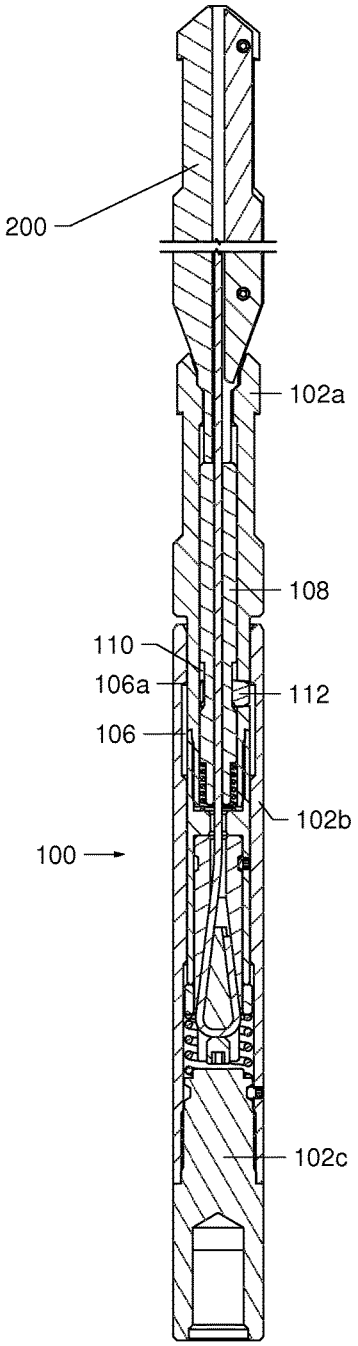
FIG. 3 shows an unlocked configuration of one embodiment of an improved rope socket.

The indent 110 is configured to accept at least a portion of a lug 112, when the release plunger 108 is in the unlocked position wherein the indent 110 is substantially aligned with the lug 112 (as shown in FIG. 3). The lug 112 is substantially disposed within an opening through a wall of the upper sub 102*a*, and configured to have a width greater than that of the wall in which it is disposed, such that it will protrude from the wall into either the internal fishing neck 106, or the indent 110, corresponding to whether the rope socket 100 is in a locked, or unlocked, configuration. Outward protrusion of the lug 112 into the internal fishing neck 106 prevents the upper sub 102*a* from being upwardly displaced (relative to the fish neck sub 102*b*) and thus removed from its nested connection with the fish neck sub 102*b*, because the vertical movement of that portion of the lug 112 protruding into the internal fishing neck 106 is limited at an upper end of the internal fishing neck 106 by the internal fishing neck shoulder 106*a*.

Embodiments of the lug 112 may be of varying shapes and sizes, and will generally be configured to limit undesired displacement within the rope socket 100. As shown in the magnified view of FIG. 1B, the lug 112 may comprise a plurality of generally planar surfaces configured to serve as contact areas for various components of the rope socket 100 configured to retain, and/or cause a desired displacement of, the lug 112, in or between a first (locked) position protruding into the internal fishing neck 106 of the fish neck sub 102*b*, and a second (unlocked) position (shown in FIGS. 3-5) protruding into the indent 110 of the release plunger 108. The locked and unlocked positions of the lug 112 will typically be represented by an outward orientation, and an inward orientation, respectively, relative to the midline of the rope socket 100.

Interaction between a tapered surface of the lug 112 and a tapered upper shoulder 106*a* of the internal fishing neck 106 will bias the lug 112 inwardly towards an unlocked position when the surfaces are pressed together via, e.g., pulling of the wireline 180 and/or pressure from one or more springs. However, the lug 112 is prevented from moving into the unlocked position unless aligned with the indent 110 of the release plunger 108, as will be later shown and described.

Other configurations of the lug 112, and corresponding contact areas of the internal fishing neck 106 configured to bias the lug 112 towards an unlocked position, may also be utilized (e.g., curved surfaces). In certain embodiments, a plurality of lugs 112 may be used. In one embodiment, a rotatable lug 112 may be used, and configured to rotate (or pivot) between a first orientation protruding into the internal fishing neck 106, and a second orientation protruding into the indent 110 of the release plunger 108. In one embodiment, the lug 112 may have a round or ovoid shape, or at least one rounded surface.

Figure 1B:
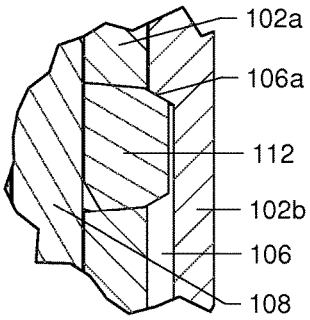

As shown in the enlarged view of FIG. 1B, the opening in the wall of the upper sub 102*a* will generally be configured to accommodate a predetermined configuration/size of lug 112. In one embodiment, one or more walls of the opening will be tapered to prevent full egress of the lug 112 in at least one direction. For example, it may be desirable to limit displacement of the lug 112 into the internal fishing neck 106 of the fish neck sub 102*b*, while still allowing for removal/replacement of the lug 112 via the cavity 104 of the upper sub 102*a*. Thus, in such a configuration, the opening may be narrower on the side of the internal fishing neck 106, and wider on the side of the cavity 104.

Figure 2:
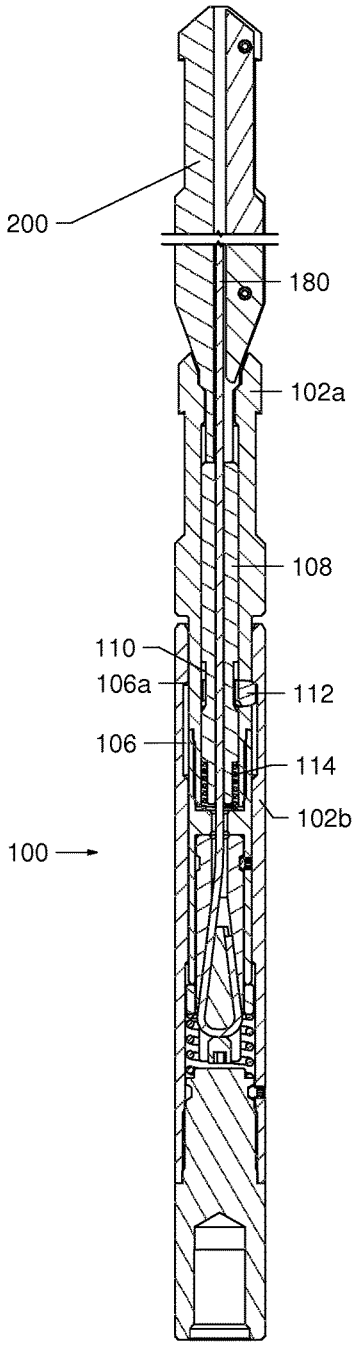
FIG. 2 shows one embodiment of an improved rope socket and drop bar.

As shown in the embodiment of FIG. 2, movement of the lug 112 between a first (locked) position, and a second (unlocked) position is enabled when the release plunger 108 moves downwardly within the rope socket 100 until the indent 110 of the release plunger is sufficiently aligned with the lug 112 to permit movement of the lug 112 into the indent 110. The downward movement of the release plunger 108 within the rope socket 100 is achieved by a downward force exerted upon the release plunger 108, typically via an external object such as a drop bar 200 which may be lowered down the wireline 180 until it makes contact with the release plunger 108. Once the downward force on the release plunger 108 sufficiently overcomes the upward force exerted upon the release plunger 108 by the release plunger spring 114 to align the indent 110 of the release plunger 108 with the lug 112, movement of the lug 112 into the indent 110 will be possible.

Figure 4:
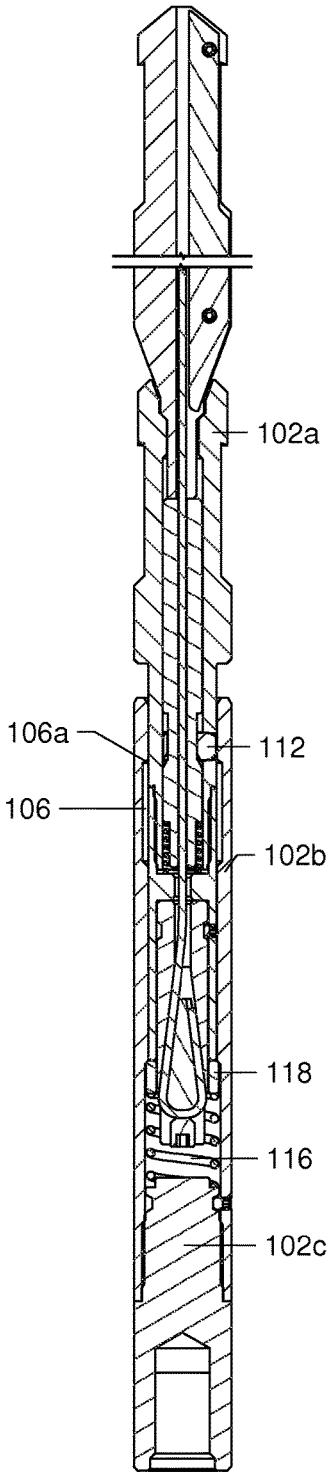
FIG. 4 shows one embodiment of an improved rope socket, during separation.

As shown in the embodiment of FIG. 3, upon alignment of the indent 110 of the release plunger 108 with the lug 112, pulling upon the wireline 180 (and/or the weight of the tool string 190 beneath the rope socket 100, and/or pressure from a power spring as will be later described) will cause an increasing interaction of the lug 112 with the tapered shoulder 106*a* of the internal fishing neck 106, causing inward displacement of the lug 112 such that it protrudes into the indent 110 and no longer substantially protrudes into the internal fishing neck 106, until the lug 112 is able to clear the tapered shoulder 106*a* of the internal fishing neck 106. At such time, as shown in the embodiment of FIG. 4, the upper sub 102*a* and attached components, may be displaced from their substantially nested (i.e., running or locked) engagement with the fish neck sub 102*b*, which remains operatively connected to the lower sub 102*c*, and remainder of the tool string 190 (not shown in FIG. 4).

In addition to the upward force exerted by pulling on the wireline 180 (e.g., from a surface location), embodiments of the rope socket 100 may utilize a power spring 116 disposed beneath one or more components of the upper sub 102*a* to exert an upward force on the upper sub 102*a*, thereby advantageously aiding separation of the upper sub 102*a* from the fish neck sub 102*b* and lower sub 102*c*, once the lug 112 is unlocked from the internal fishing neck 106. A power spring washer 118 may be disposed between the power spring 116 and the bottom of the upper sub 102*a*, to limit extension of the power spring 116 to a desired range. The upward force exerted by the power spring 116 also helps to force the lug 112 into the indent 110 when the two are aligned, by exerting a pushing force on the lug 112 against the tapered shoulder 106*a* of the internal fish neck 106.

Figure 5:
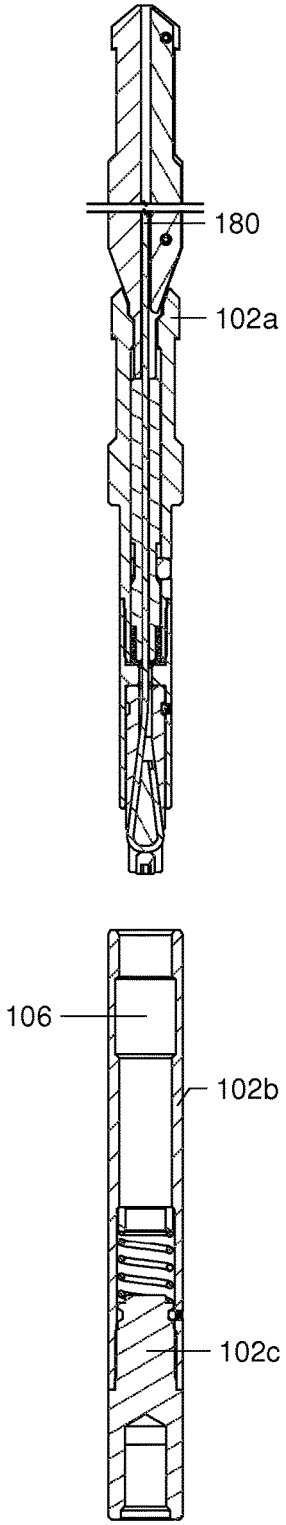
FIG. 5 shows one embodiment of an improved rope socket, after separation.

As shown in the embodiment of FIG. 5, once separation of the upper sub 102*a* (and components thereof) from the fish neck sub 102*b* is completed, the upper sub 102*a* and the entirety of the wireline 180 may then be removed from the wellbore, leaving the fish neck sub 102*b* and lower sub 102*c* attached to the tool string/fish 190 (not shown in FIG. 5), to provide an uphole-facing and unobstructed internal fishing neck 106 for use in future retrieval efforts, and other endeavors.

Various mechanisms may be used to connect the wireline 180 within the rope socket 100. Referring again to the embodiment of FIG. 1A, a wedge receiving sub 120 is disposed substantially within the fish neck sub 102*b*, and includes an upper portion configured to permit at least a partial nesting of a lower end of the upper sub 102*a*, and a lower portion configured to permit at least a partial nesting of various components configured to connect the wireline 180, as will be shown and described.

In one embodiment, the release plunger spring 114 is disposed between the release plunger 108 of the upper sub 102*a*, and the wedge receiving sub 120. As the release plunger 108 is displaced downwardly within the rope socket 100, the release plunger spring 114 will be compressed.

The lower portion of the wedge receiving sub 120 is configured to accept a wedge 122 for operatively connecting the wireline 180 within the rope socket 100. A continuous passage for the wireline 180 is provided through various components of the rope socket 100 (e.g., the top sub 102*a*, release plunger 108, wedge receiving sub 120, etc.) such that when a terminal end of the wireline 180 is connected within the rope socket 100, the wireline 180 will extend through the center of the rope socket 100 to a surface location. A set screw 124 or similar may be used to lock the wireline 180 against the wedge 120.

Other mechanisms for connecting the wireline 180 within the rope socket 100 may also be utilized with various embodiments of the release mechanisms described herein. Generally, these will be configured such that the wireline 180 will remain connected to one or more separable upper subassemblies, such that it may be utilized to retrieve the separable upper subassembly, once separated from one or more lower subassemblies configured to provide an uphole-facing internal fishing neck. While shown and described herein with a wedge type connection, spool type, slip type, clamp type, and other connection mechanisms may also be used in embodiments of the rope socket 100 to connect the wireline 180.

In one embodiment, the rope socket 100 may be configured to automatically separate when a predetermined pulling force is exerted on the wireline 180, the predetermined pulling force being less than the pulling force required to break the wireline 180. This may be accomplished by, e.g., configuration of a lug 112 such that it will shear when the predetermined pulling force is exerted. Such a configuration advantageously lessens the likelihood of breaking the wireline 180 when attempting to remove a fish 190 via the rope socket 100. In one embodiment, the rope socket 100 will be configured to utilize lugs 112 of various shear strengths, such that the lugs 112 may be selected based on anticipated breakage criteria of select wirelines 180.

In one embodiment, the lug 112 may comprise multiple subcomponents configured to separate once a predetermined force is exerted upon the lug 112. If configured with a pivoting/rotating lug 112, the rotation mechanism may be configured to rotate the lug 112 (or fail) once a predetermined rotational force is exerted. Other mechanisms for shearing, moving, or rotating the lug 112 at forces selected to avoid breakage of the wireline 180 may also be utilized.

In one embodiment, the rope socket 100 may be configured to automatically separate upon passage of a predetermined time interval. Such a time release configuration may include a hydraulic pressure release system configured to bleed off hydraulic pressure at a known rate over time. Once pressure within the hydraulic system reaches a predetermined level, the indent 110 will become aligned with the lug 112 and the rope socket 100 will become unlocked for separation. In one embodiment, the release plunger 108 and cavity 104 will be configured to maintain a hydraulic pressure and operate as described. In one embodiment, slacking off of the wireline 180 will initiate the hydraulic release mechanism.

While embodiments of the rope socket 100 housing preferably include at least three subs (102*a*, 102*b*, 102*c*), other embodiments may be configured using more or less subs. For example, the fish neck sub 102*b* and lower sub 102*c* may be combined into a single sub, however, the separability of these subs provides a number of assembly and field-redressing advantages, such as allowing for simplified placement of the power spring 116 and/or power spring washer 118 in the interface between the fish neck sub 102*b* and lower sub 102*c*, and/or a simplified system for connecting the wireline 180 during assembly of the rope socket 100. As previously mentioned, a crossover sub may be used with (or in place of) the lower sub 102*c* to permit connection of various tool string 190 connectors.

Figure 6A:
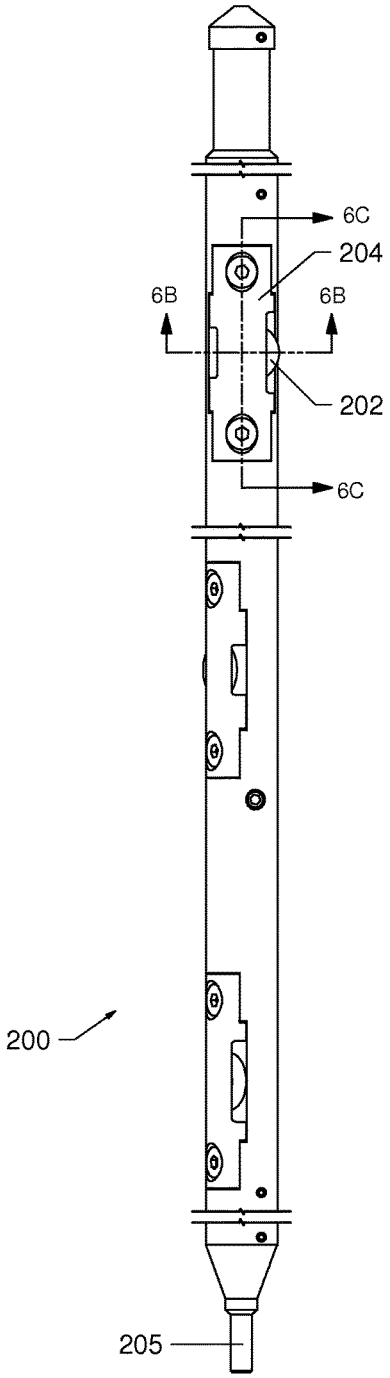
FIGS. 6A-6D show one embodiment of a drop bar.

As shown in FIG. 6A, one embodiment of an actuating device for the rope socket 100 is a drop bar 200 comprising a plurality of offset wheels 202 secured to the drop bar 200 via inserts 204. The drop bar 200 may be configured with a slim nose 205 configured to be capable of entering the upper sub of a rope socket (not shown in FIG. 6A) to contact an actuating component (e.g., a release plunger) disposed in a cavity thereof.

Figure 6B:
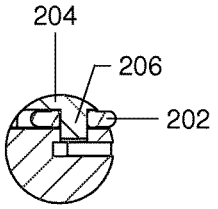

As shown in FIG. 6B, each insert 204 includes an integrated axle 206 about which the wheel 202 rotates. Because the integrated axle 206 does not require attachment/rotation points on both sides of each wheel 202, a more robust axle configuration is provided in a more compact space versus traditional configurations which required attachment points on both sides of each wheel, for anchoring a separate roll pin. A significant benefit of such an offset wheel assembly configuration is that only a portion of each wheel 202 will protrude from the drop bar 200, ensuring that other portions of the wheel(s) 202 do not otherwise protrude from the drop bar 200 in a manner that would interfere with desired movement of the drop bar 200.

Figure 6C:
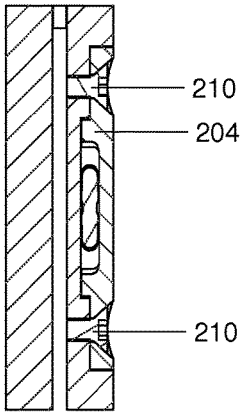

As shown in FIG. 6C, attachment of the insert 204 to the drop bar 200 may be via one or more countersink screws 210, advantageously permitting a low-profile, field-redressable wheel configuration that permits repair, replacement, and resizing of wheels in the field without requiring any significant disassembly of the drop bar 200. Generally, a plurality of wheel assemblies (wheel and insert combinations) will be used along the length of the drop bar 200 at various locations offset around the drop bar circumference to provide rolling contact points between the drop bar 200 and any tubular structure(s) into which it is run. Thus, the assemblies would be distributed both along the length of the drop bar 200, and around the circumference of the drop bar 200 to provide a desired rolling interface between the drop bar 200 and surrounding tubular structure(s) through which it may pass.

Figure 6D:
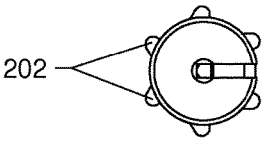

Referring now to FIGS. 6A and 6D, offsetting of wheel assemblies may be both longitudinally (along the length of the drop bar 200) and circumferentially (along its circumference). Longitudinal offsetting advantageously ensures that no one area of the drop bar 200 is overly weakened due to the placement of multiple wheel assemblies, while Circumferential offsetting, as previously discussed, ensures that substantially the entire circumference of the drop bar 200 will be provided with a rolling contact point (i.e., wheel) to enhance movement within a tubular structure, as shown in FIG. 6D. In one embodiment, the circumference (360 degrees) divided by the number of wheel assemblies (e.g., 6) yields the radial offset along the circumference (approximately 60 degrees in the 6-wheel embodiment shown).

In one embodiment (not shown), two or more wheels and associated axles may be combined into a single wheel assembly. Thus the insert would include a plurality of axles, possibly offset, for attaching a plurality of wheels.

While a drop bar 200 may be used as an actuating device for actuating the release mechanism of the rope socket 100, other mechanisms may also be utilized. For example, other weighted assemblies lowered onto the rope socket 100 within a wellbore may be utilized, or actuation may be initiated via a signal sent via the wireline (or a separate communication device) to cause actuation of the release mechanism. In one embodiment (not shown) an additional spring may be disposed above the release plunger 108 within the cavity 104 and locked in a compressed configuration. A predetermined pulling force on the wireline 180 (or some other activation mechanism) would release the spring to push the release plunger 108 down the cavity, thus actuating the release mechanism of the rope socket 100.

In one embodiment, assembly of a rope socket 100 comprises the placing of an upper sub 102*a* into a nested (or partially nested) relationship with a lower subassembly (or one or more components thereof, such as a fish neck sub 102*b*) such that a portion of the upper sub 102*a* is disposed within a portion of the lower subassembly, and an opening in a wall of a cavity 104 of the upper sub 102*a* is aligned with a portion of an internal fishing neck 106 of the lower subassembly. A lug 112 disposed within the opening in the cavity wall will be positioned such that a portion of the lug 112 protrudes into the internal fishing neck 106, while movement of the lug 112 is at least partially blocked by a release plunger 108 disposed in the cavity 104. Prior to or during assembly, a wireline 180 or similar is operatively connected to one or more components of the upper sub 102*a*.

Advantages of embodiments of the improved rope socket and combinations thereof as described herein, may include, but are not limited to: (1) increased reliability in use, (2) capability of field redressing, (3) maintenance of outer diameter (OD) during actuation/separation, and (4) providing a stronger (internal) fishing neck for additional retrieval operations. Unique configurations according to select embodiments disclosed include an enclosed actuation mechanism (the locking/unlocking components are fully enclosed), and the capability of conversion from external fish neck to internal fish neck while deployed in a wellbore.

As used herein, the concept of "separation" of the rope socket 100 means the disconnecting of one or more components of the rope socket 100 from one or more other components of the rope socket 100, such that a predetermined first group of components of the rope socket 100 may be removed from the wellbore via the wireline, while a predetermined second group of components of the rope socket 100 will remain within the wellbore, attached to the tool string or fish. Typically, the first group of components will include the upper sub 102*a* and the second group of components will include the lower sub 102*c* and an operatively connected (via e.g., a fish neck sub 102*b*), or integral, internal fishing neck 106.

As used herein, the terms "lower," "bottom," or "bottom sub" typically refer to that section or end of the rope socket 100 which will be located closer to the tool string 190 (or nearer the bottomhole), while the terms "upper," "top," or "top sub" typically refer to that section or end of the rope socket 100 which will be located further from the tool string 190 (or in the direction of a surface operations location). Thus, upon entry into a vertical wellbore, the "top" or "top sub" section of the rope socket 100 will be above the "bottom" or "bottom sub" section of the rope socket 100 when the rope socket 100 is operatively connected to a wireline 180 suspended in the wellbore. Similarly, the terms "upper" and "lower" refer to relative locations as determined relative to a position in a vertical wellbore.

While generally described for use with wireline 180, embodiments of the rope socket 100 may be used with other types of cabling used for lowering equipment into a wellbore, including braided, electric, slickline, and other line configurations. The terms "tool string" and "fish" are sometimes used herein interchangeably and will be understood by one skilled in the art to refer to unstuck and stuck conditions of the tool string, respectively.

The various components of embodiments of the rope socket 100 and drop bar 200 described herein may be formed of any material or combination of materials known in the art. Furthermore, dimensions of the various components may vary from those depicted in the figures. While various components are generally shown having a cylindrical configuration, the shape and configurations of such components may vary, so long as the capability for desired movements, interactions, and fit, is maintained.

The terms "comprising," "including," and "having," as used in the claims and specification herein, indicate an open group that includes other elements or features not specified. The terms "a," "an" and the singular forms of words include the plural form of the same words, and the terms mean that one or more of something is provided. The terms "at least one" and "one or more" are used interchangeably.

The term "one" or "single" shall be used to indicate that one and only one of something is intended. Similarly, other specific integer values, such as "two," are used when a specific number of things is intended. The terms "preferably," "preferred," "prefer," "optionally," "may," and similar terms are used to indicate that an item, condition or step being referred to is an optional (not required) feature of an embodiment.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A rope socket, comprising:

a first subassembly comprising:

a cavity, at least one opening in a wall surrounding the cavity, a moveable release plunger comprising a continuous longitudinal wireline passage therethrough, and at least substantially disposed within the cavity and comprising at least one indent formed in an external sidewall thereof; and at least one wireline connection mechanism disposed in a lower portion of the first subassembly beneath the moveable release plunger;

a second subassembly comprising an internal fishing neck and configured to accept the lower portion of the first subassembly; and at least one lug at least partially disposed within the opening in the wall surrounding the cavity, the at least one lug moveable between a first position protruding into the internal fishing neck, and a second position that does not substantially protrude into the internal fishing neck.

2. The rope socket of claim 1, wherein an upper end of the internal fishing neck comprises a tapered shoulder.

3. The rope socket of claim 1, comprising at least one power spring configured to assist separation of the first subassembly from the second subassembly.

4. The rope socket of claim 1, wherein the second subassembly comprises a fish neck sub comprising the internal fishing neck, operatively connected to a lower sub comprising at least one connection component configured to operatively connect to a tool string.

5. The rope socket of claim 4, wherein the at least one connection component comprises threads.

6. The rope socket of claim 4, wherein the at least one connection component comprises a crossover sub.

7. The rope socket of claim 1, wherein the lug comprises at least one rounded surface.

8. The rope socket of claim 1, wherein the first subassembly comprises an external fishing neck.

9. The rope socket of claim 1, further comprising a release plunger spring configured to push the moveable release plunger towards an upper end of the cavity.

10. The rope socket of claim 1, wherein at least one selected from the first subassembly, the second subassembly, the cavity, and the release plunger, has a generally cylindrical configuration.

11. A method of separating a wireline from a tool string within a wellbore, comprising:

operatively connecting an actuating device to the wireline;

lowering the actuating device into the wellbore;

actuating a separation mechanism of a rope socket with the actuating device, the rope socket comprising an upper subassembly at least partially nested in a lower subassembly and having at least one wireline connection mechanism disposed in a lower nested portion of the upper subassembly; and removing the actuating device and separated upper subassembly of the rope socket from the wellbore via the wireline, leaving a separated lower subassembly of the rope socket connected to the tool string, the separated lower subassembly comprising an uphole-facing internal fishing neck.

12. The method of claim 11, wherein actuation of the separation mechanism comprises moving of a lug from a first position protruding into the internal fishing neck, to a second position that does not substantially protrude into the internal fishing neck, to permit separation of the upper subassembly from the lower subassembly.

13. The method of claim 12, wherein moving of the lug from the first position to the second position is preceded by moving of a release plunger from a first position blocking movement of the lug, to a second position permitting movement of the lug into an indent of the release plunger.

14. The method of claim 11, wherein the actuating device is a drop bar.

15. The method of claim 14, wherein the drop bar comprises a plurality of wheels connected to the drop bar by a plurality of inserts, the inserts each comprising at least one integrated axle on which one of the plurality of wheels is disposed.

16. The method of claim 14, wherein the tool string comprises a fish.

* * * * *